US006683239B1

(12) United States Patent
Chang

(10) Patent No.: US 6,683,239 B1
(45) Date of Patent: Jan. 27, 2004

(54) DRUM RACK ASSEMBLY HAVING A DISTANCE ADJUSTMENT FUNCTION

(76) Inventor: Jung-Pin Chang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/423,610

(22) Filed: Apr. 25, 2003

(51) Int. Cl.[7] ..... G10D 13/02
(52) U.S. Cl. ..... 84/421
(58) Field of Search ..... 84/422.1, 422.2, 84/422.3, 421

(56) References Cited

U.S. PATENT DOCUMENTS 4,869,147 A * 9/1989 Hoshino ..... 84/421
6,093,878 A * 7/2000 Hoshino ..... 84/421
6,162,978 A * 12/2000 Chang ..... 84/421

OTHER PUBLICATIONS

Wexler Catalog □□ Rapid Index Catalog No. 66.*
Bruno and Sons Inc. □□ Catalog No. 96.*

* cited by examiner

*Primary Examiner*—Kimberly Lockett

(57) ABSTRACT

A drum rack assembly includes a support seat, a connecting seat, and a press seat. Thus, the drum rack assembly has a distance adjustment function. In addition, the connecting seat has a V-shaped bottom face mounted on the V-shaped recessed face of the support seat, so that the connecting seat is. combined with the support seat easily and rapidly. Further, the V-shaped recessed face of the support seat can calibrate the center of gravity of the connecting seat, so that the connecting seat is combined with the support seat rigidly and stably.

10 Claims, 6 Drawing Sheets

DRUM RACK ASSEMBLY HAVING A DISTANCE ADJUSTMENT FUNCTION

BACKGROUND OF THE INVENTION

1. Field of the Invention

The present invention relates to a drum rack assembly, and more particularly to a drum rack assembly having a distance adjustment function.

2. Description of the Related Art

A conventional drum rack 2 in accordance with the prior art shown in FIG. 1 has a lower portion fixed on a larger drum 1 and an upper portion fixed on two smaller drums 3. However, the conventional drum rack 2 has a fixed structure, so that the distance between the larger drum 1 and the two smaller drums 3 cannot be adjusted, thereby causing inconvenience to the users of different statures, and thereby greatly decreasing the versatility of the conventional drum rack 2.

SUMMARY OF THE INVENTION

The primary objective of the present invention is to provide a drum rack assembly having a distance adjustment function.

Another objective of the present invention is to provide a drum rack assembly, wherein the connecting seat has a V-shaped bottom face mounted on the V-shaped recessed face of the support seat, so that the connecting seat is combined with the support seat easily and rapidly.

A further objective of the present invention is to provide a drum rack assembly, wherein the V-shaped recessed face of the support seat can lead the center of gravity of the connecting seat, so that the connecting seat is combined with the support seat rigidly and stably.

A further objective of the present invention is to provide a drum rack assembly, wherein the V-shaped bottom face of the connecting seat is mounted on the V-shaped recessed face of the support seat and the arcuate top face of the connecting seat is mounted on the arcuate concave face of the press seat to increase the contact area between the connecting seat, the support seat and the press seat, such that the drum rack assembly can withstand a larger striking force.

A further objective of the present invention is to provide a drum rack assembly, wherein the two springs are mounted between the press seat and the support seat to prevent the connecting seat from being deformed due to an excessive force.

A further objective of the present invention is to provide a drum rack assembly, wherein the press seat is pushed upward by the restoring force of the two springs, thereby detaching the connecting seat from the press seat, so that the connecting seat can be moved relative to the support seat freely, so as to adjust the distance between the support rack the connecting seat easily and rapidly.

A further objective of the present invention is to provide a drum rack assembly, wherein the two springs are mounted between the press seat and the support seat to prevent from incurring noise due to the effect of resonance.

In accordance with the present invention, there is provided a drum rack assembly, comprising a support seat, a connecting seat, and a press seat, wherein:

the support seat has a middle portion formed with a V-shaped recessed face;

the connecting seat is mounted on the support seat and has a V-shaped bottom face slidably mounted on the recessed face of the support seat; and the press seat is mounted on the connecting seat and has two ends each mounted on the support seat.

Further benefits and advantages of the present invention will become apparent after a careful reading of the detailed description with appropriate reference to the accompanying drawings.

DETAILED DESCRIPTION OF THE INVENTION

Figure 1:
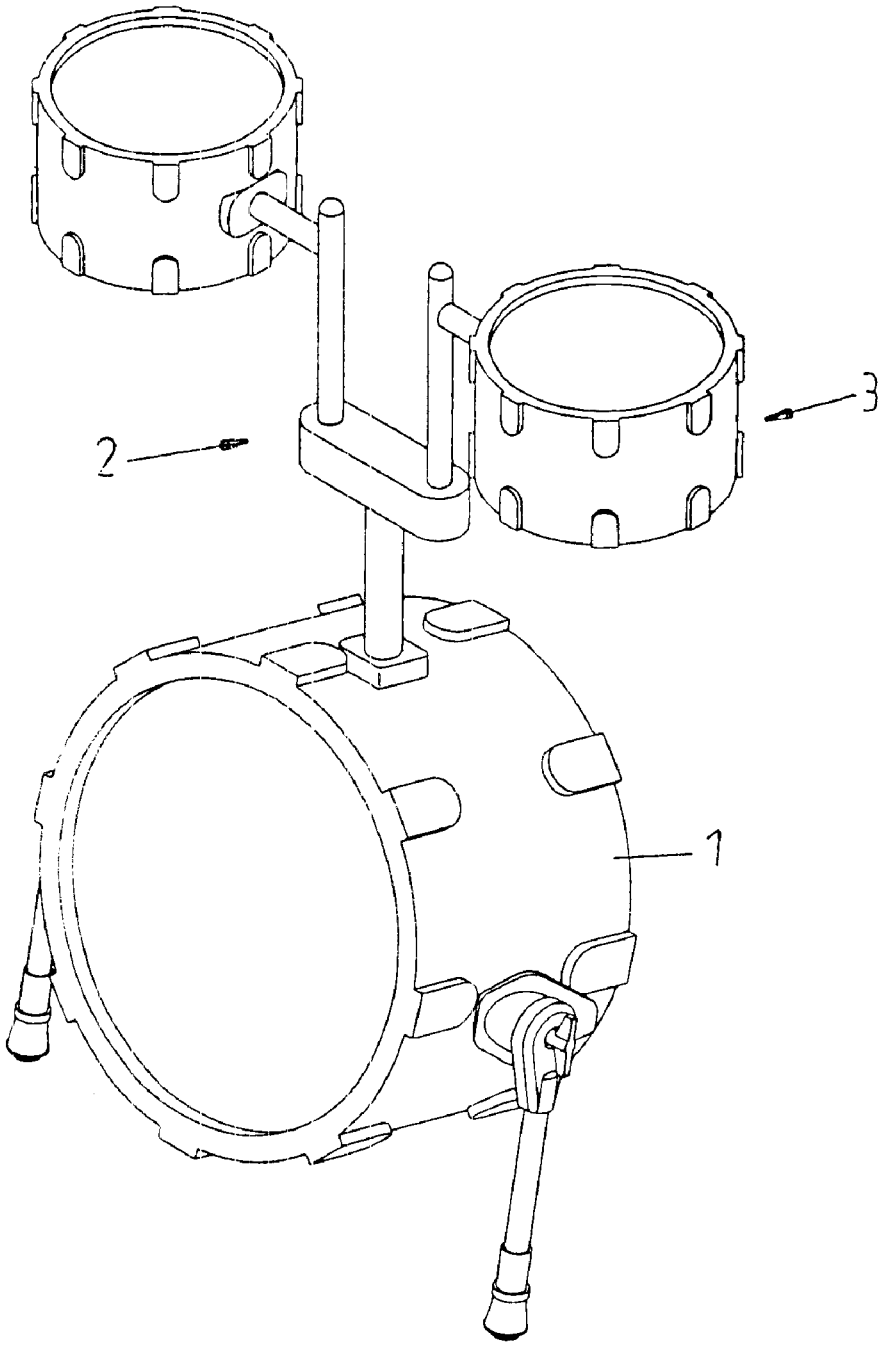
FIG. 1 PRIOR ART
FIG. 1 is a perspective view of a conventional drum rack in accordance with the prior art.
Figure 2:
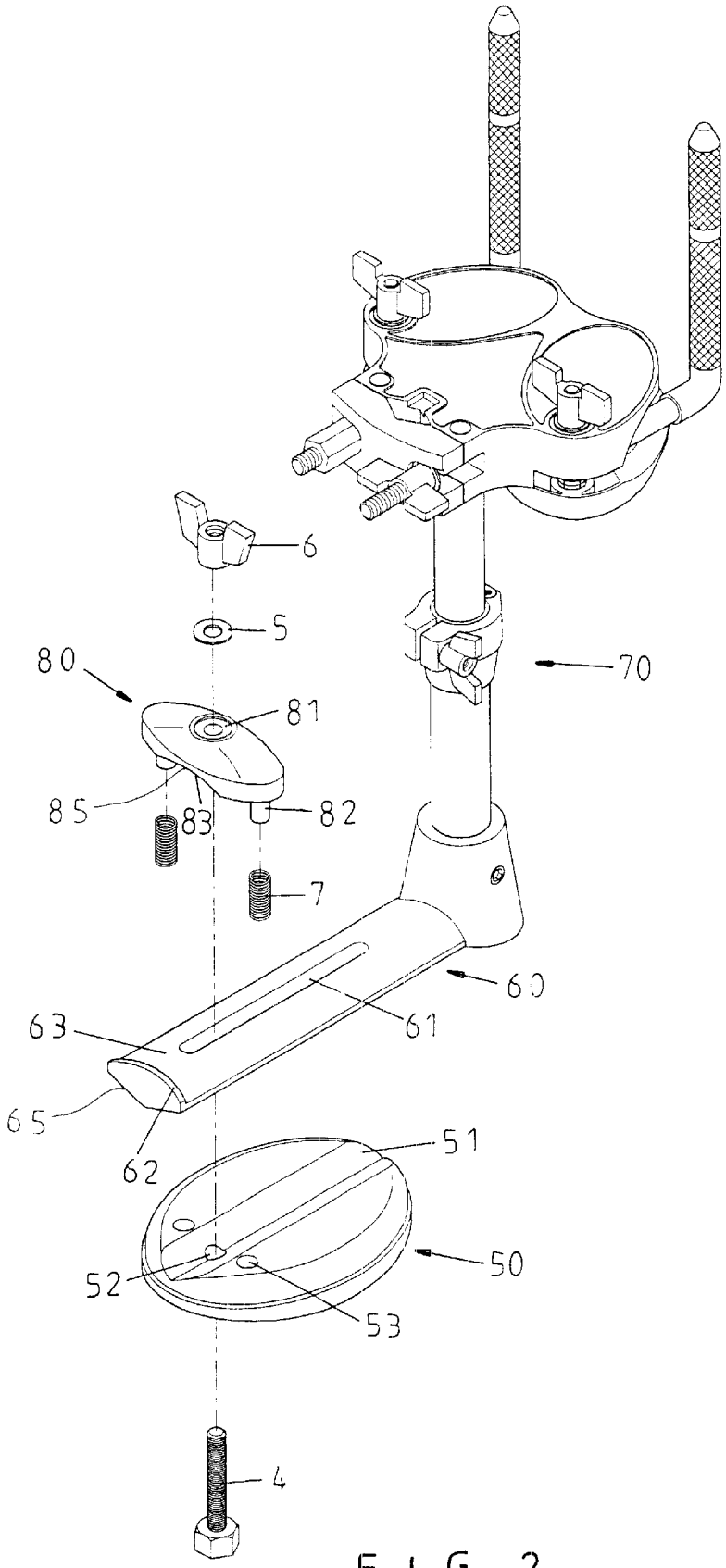
FIG. 2 is an exploded perspective view of a drum rack assembly in accordance with the preferred embodiment of the present invention.
Figure 3:
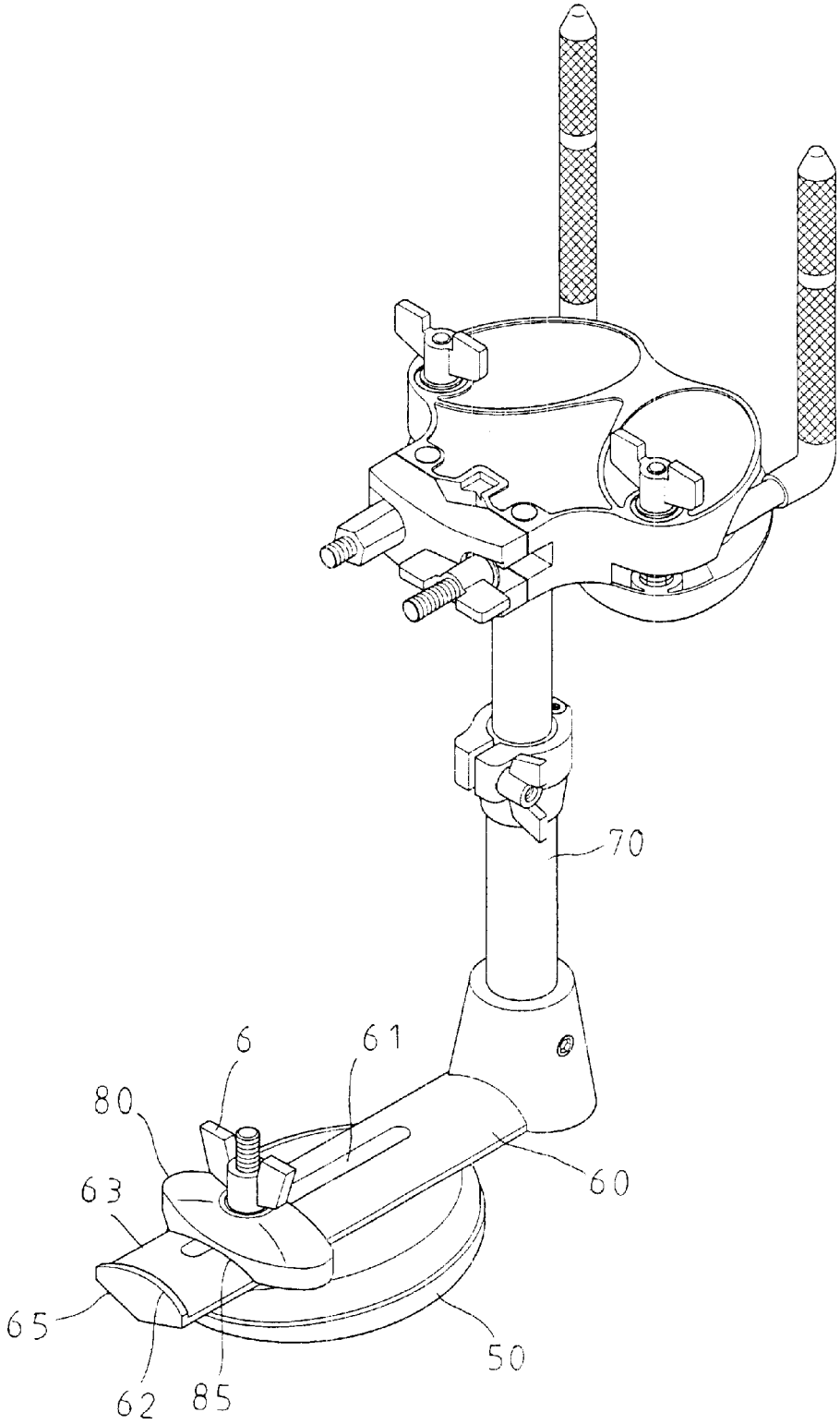
FIG. 3 is a perspective assembly view of the drum rack assembly in accordance with the preferred embodiment of the present invention.
Figure 4:
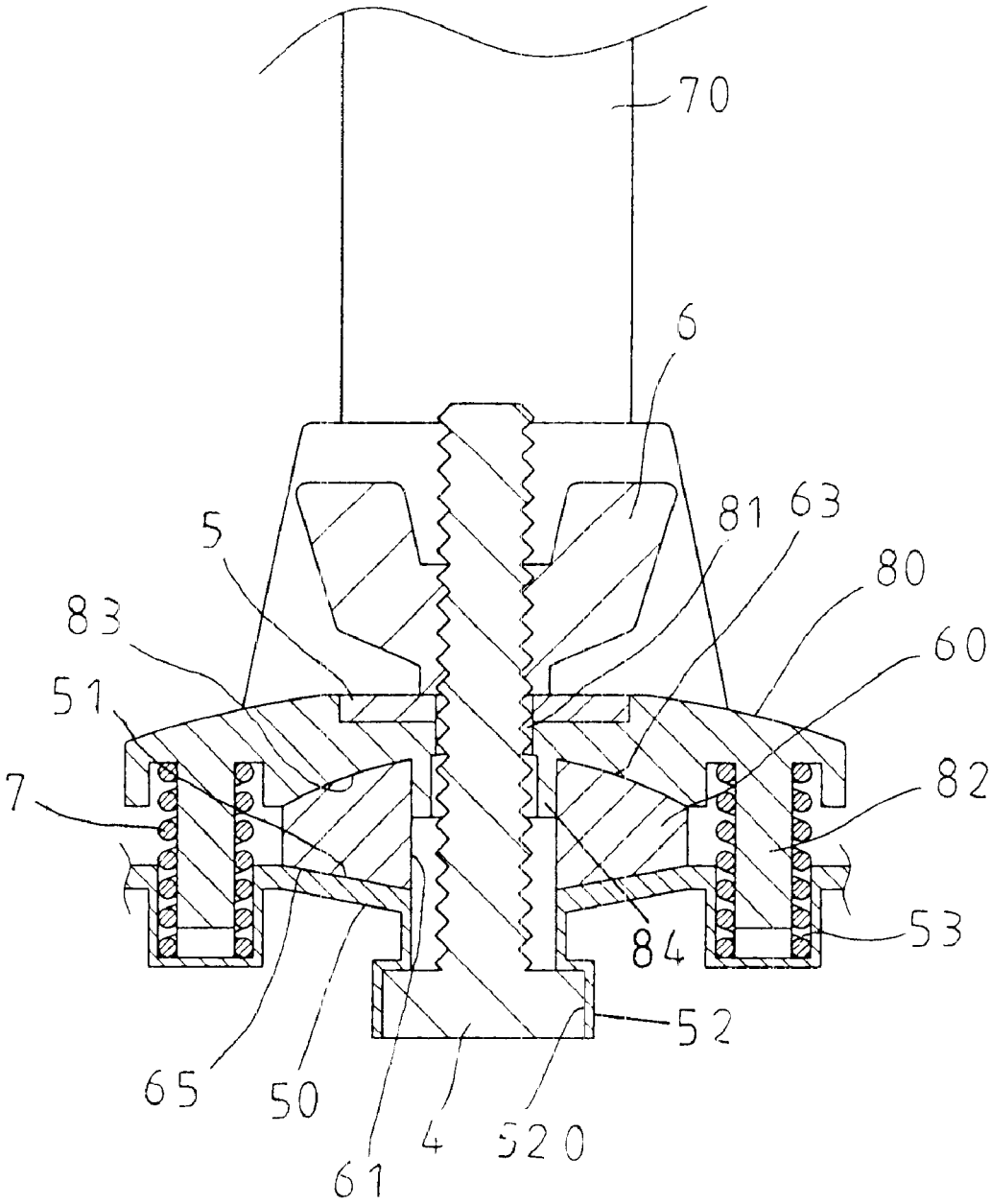
FIG. 4 is a partially cut-away side plan cross-sectional view of the drum rack assembly as shown in FIG. 3.

Referring to the drawings and initially to FIGS. 2–4, a drum rack assembly in accordance with the preferred embodiment of the present invention comprises a support seat 50, a connecting seat 60, and a press seat 80.

The support seat 50 is fixed on the larger drum (not shown) and has a middle portion formed with a V-shaped recessed face 51 and two receiving holes 53 located beside the recessed face 51. The recessed face 51 of the support seat 50 has a bottom portion 52 extended downward and formed with a stepped hole 520.

The connecting seat 60 is mounted on the support seat 50 and has a V-shaped bottom face 65 slidably mounted on the recessed face 51 of the support seat 50. The connecting seat 60 has an arcuate top face 63. The connecting seat 60 has a middle portion formed with an oblong guide slot 61 aligning with the stepped hole 52 of the support seat 50. The connecting seat 60 has a first end formed with an abutment 62 extended upward.

The drum rack assembly further comprises a support rack 70 having a lower end mounted on a second end of the connecting seat 60. The support rack 70 is used to support two smaller drums (not shown).

The press seat 80 is mounted on the connecting seat 60 and has two ends each mounted on the support seat 50. The press seat 80 has a side face 85 rested on the abutment 62 of the connecting seat 60. The press seat 80 has a bottom formed with an arcuate concave face 83 mounted on the arcuate top face 63 of the connecting seat 60. The concave face 83 of the press seat 80 is formed with a slide 84 extended downward and slidably mounted in the guide slot 61 of the connecting seat 60. The press seat 80 has a top face formed with a stepped through hole 81 aligning with the guide slot 61 of the connecting seat 60. Each of the two ends of the press seat 80 has a bottom formed with an insertion portion 82 extended downward and received in a respective one of the two receiving holes 53 of the support seat 50. Preferably, the insertion portion 82 of the press seat 80 has a length greater than the of the slide 84.

The drum rack assembly further comprises two springs 7 each having a first end secured on the respective insertion portion 82 of the press seat 80 and a second end secured in a respective one of the two receiving holes 53 of the support seat 50.

The drum rack assembly further comprises a locking bolt 4 extended through the stepped hole 52 of the support seat 50, the guide slot 61 of the connecting seat 60 and the through hole 81 of the press seat 80, and a wing nut 6 screwed on the locking bolt 4 and rested on the press seat 80, so that the press seat 80, the connecting seat 60 and the support seat 50 are combined together.

The drum rack assembly further comprises a washer 5 mounted on the locking bolt 4 and urged between the press seat 80 and the wing nut 6.

In operation, the press seat 80, the connecting seat 60 and the support seat 50 are combined together by the locking bolt 4 and the wing nut 6. After the wing nut 6 is unscrewed from the locking bolt 4, the press seat 80 is pushed upward by the restoring force of the two springs 7, thereby detaching the connecting seat 60 from the press seat 80, so that the connecting seat 60 can be moved relative to the support seat 50 freely, so as to adjust the distance between the support rack 70 the connecting seat 60, thereby adjusting the distance between the two smaller drums and the larger drum.

Figure 5:
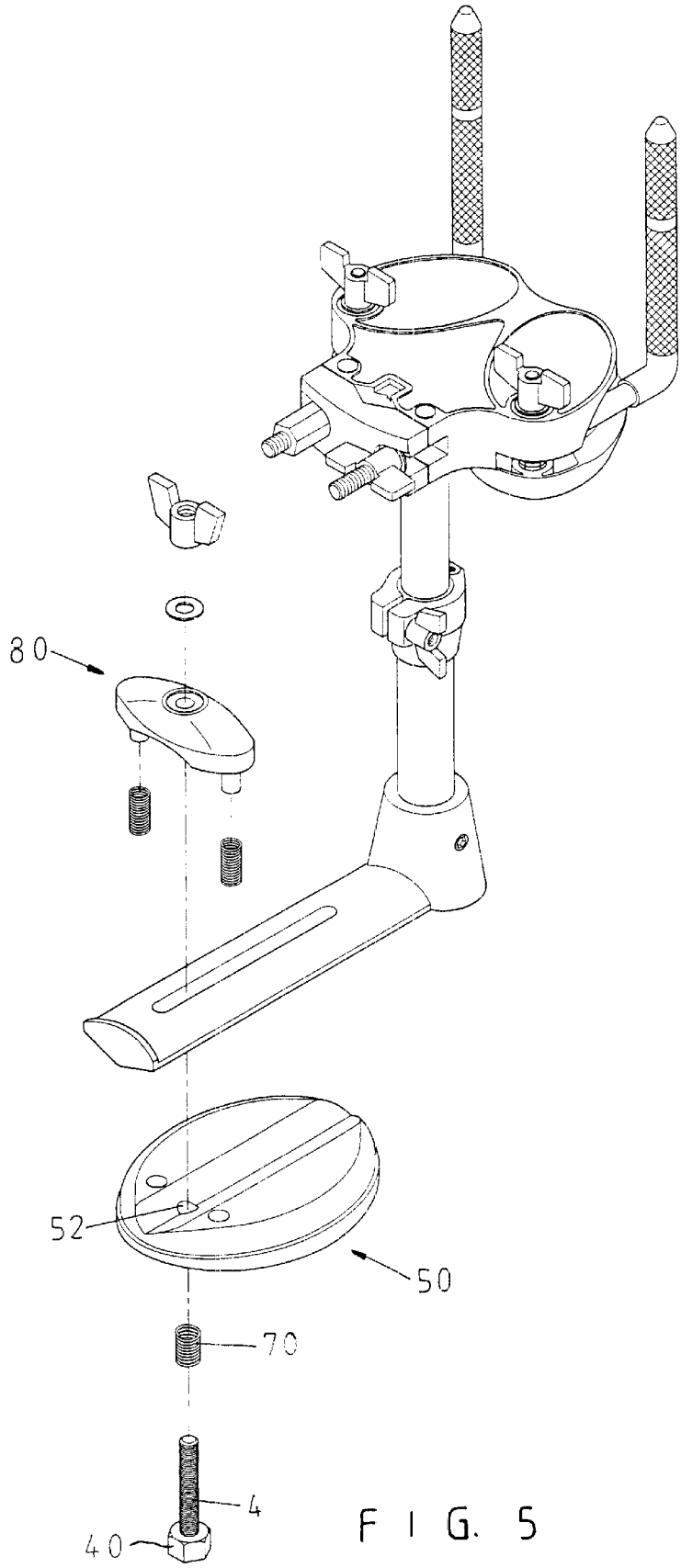
FIG. 5 is an exploded perspective view of a drum rack assembly in accordance with another embodiment of the present invention.
Figure 6:
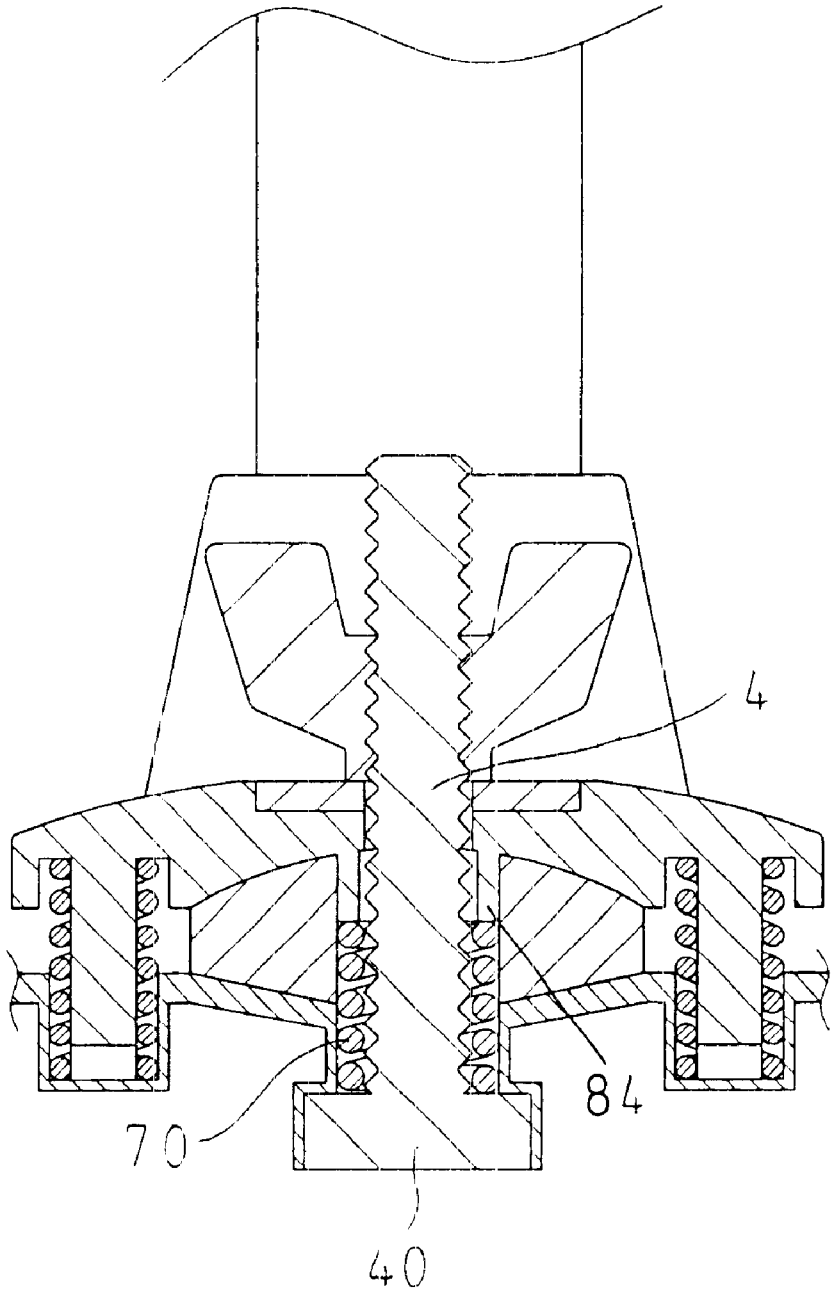
FIG. 6 is a partially cut-away side plan cross-sectional assembly view of the drum rack assembly as shown in FIG. 5.

Referring to FIGS. 5 and 6, the drum rack assembly in accordance with another embodiment of the present invention further comprises a second spring 70 mounted on the locking bolt 4 and urged between the slide 84 of the press seat 80 and a head of the locking bolt 4.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A drum rack assembly, comprising a support seat, a connecting seat, and a press seat, wherein:

the support seat has a middle portion formed with a V-shaped recessed face;

the connecting seat is mounted on the support seat and has a V-shaped bottom face slidably mounted on the recessed face of the support seat; and the press seat is mounted on the connecting seat and has two ends each mounted on the support seat.

2. The drum rack assembly in accordance with claim 1, wherein the support seat is formed with two receiving holes located beside the recessed face, and each of the two ends of the press seat has a bottom formed with an insertion portion extended downward and received in a respective one of the two receiving holes of the support seat.

3. The drum rack assembly in accordance with claim 2, further comprising two springs each having a first end secured on the respective insertion portion of the press seat and a second end secured in a respective one of the two receiving holes of the support seat.

4. The drum rack assembly in accordance with claim 1, wherein the recessed face of the support seat has a bottom portion extended downward and formed with a stepped hole, the connecting seat has a middle portion formed with an oblong guide slot aligning with the stepped hole of the support seat, the press seat has a top face formed with a stepped through hole aligning with the guide slot of the connecting seat, and the drum rack assembly further comprises a locking bolt extended through the stepped hole of the support seat, the guide slot of the connecting seat and the through hole of the press seat, and a wing nut screwed on the locking bolt and rested on the press seat, so that the press seat, the connecting seat and the support seat are combined together.

5. The drum rack assembly in accordance with claim 4, wherein the concave face of the press seat is formed with a slide extended downward and slidably mounted in the guide slot of the connecting seat.

6. The drum rack assembly in accordance with claim 4, further comprising a washer mounted on the locking bolt and urged between the press seat and the wing nut.

7. The drum rack assembly in accordance with claim 1, wherein the connecting seat has an arcuate top face, and the press seat has a bottom formed with an arcuate concave face mounted on the top face of the connecting seat.

8. The drum rack assembly in accordance with claim 1, wherein the connecting seat has an end formed with an abutment extended upward, and the press seat has a side face rested on the abutment of the connecting seat.

9. The drum rack assembly in accordance with claim 1, further comprising a support rack having a lower end mounted on an end of the connecting seat.

10. The drum rack assembly in accordance with claim 5, further comprising a spring mounted on the locking bolt and urged between the slide of the press seat and a head of the locking bolt.

* * * * *